US007710284B2

(12) United States Patent
Dzurko et al.

(10) Patent No.: US 7,710,284 B2
(45) Date of Patent: May 4, 2010

(54) AUTOMATIC GARAGE DOOR RESPONSE SYSTEM FOR CARBON MONOXIDE OR CARBON MONOXIDE AND SMOKE DETECTION

(76) Inventors: Thomas A. Dzurko, 20419 Morar Cir., Strongsville, OH (US) 44149; Edward Cogan, 1780 Sunridge Cir., Munson, OH (US) 44024; James Heidenreich, 2879 Grand River Dr., Rome, OH (US) 44085

( * ) Notice: Subject to any disclaimer, the term of this patent is extended or adjusted under 35 U.S.C. 154(b) by 477 days.

(21) Appl. No.: 11/710,714

(22) Filed: Feb. 26, 2007

(65) Prior Publication Data

US 2007/0182574 A1 Aug. 9, 2007

Related U.S. Application Data

(63) Continuation-in-part of application No. 11/087,931, filed on Mar. 23, 2005, now Pat. No. 7,183,933.

(51) Int. Cl.
*G08B 17/10* (2006.01)

(52) U.S. Cl. ..... 340/632; 73/23.2

(58) Field of Classification Search ..... 340/632; 73/23.2

See application file for complete search history.

(56) References Cited

U.S. PATENT DOCUMENTS 5,898,369 A * 4/1999 Godwin ..... 340/539.26
6,989,757 B2 * 1/2006 Geoffrey et al. ..... 340/632
7,005,994 B2 * 2/2006 King ..... 340/628
7,113,091 B2 * 9/2006 Script et al. ..... 340/546
7,183,933 B2 * 2/2007 Dzurko et al. ..... 340/632
2006/0202815 A1 * 9/2006 John ..... 340/531
2007/0083896 A1 * 4/2007 Staples ..... 725/58
2007/0120693 A1 * 5/2007 Vij ..... 340/632
2007/0146150 A1 * 6/2007 Calabrese et al. ..... 340/632
2007/0182574 A1 * 8/2007 Dzurko et al. ..... 340/632
2009/0015400 A1 * 1/2009 Breed ..... 340/539.22

FOREIGN PATENT DOCUMENTS

JP 07019948 A * 1/1995

* cited by examiner

*Primary Examiner*—Daniel Wu
*Assistant Examiner*—Bradley E Thompson
(74) *Attorney, Agent, or Firm*—John D. Gugliotta, PE, Esq

(57) ABSTRACT

A garage monitoring system is provided that determines if the garage door is opened or closed, and will not issue a move door command if the garage door is already opened and it will not issue a move door command if smoke is detected first. The system's sequence of operation is can thus be described as follows:

a. If CO is detected first, high concentration, sound alarm and open door immediately.
b. If CO is detected first, low concentration, sound alarm and wait a time period to see if smoke alarm activates. If smoke alarm does not activate, open garage door, otherwise do not change the position of the garage door.
c. If smoke is detected first, sound alarm and do not change the position of the garage door.

17 Claims, 2 Drawing Sheets

Garage Guardian System

Top View of Carriage

Side View of Carriage

AUTOMATIC GARAGE DOOR RESPONSE SYSTEM FOR CARBON MONOXIDE OR CARBON MONOXIDE AND SMOKE DETECTION

RELATED APPLICATIONS

The present application is a Continuation-in-Part of Ser. No. 11/087,931 U.S. Pub. No. 2005/0212681 A1 and now U.S. Pat. No. 7,183,933, and as such, claims the benefit of the Mar. 23, 2005 filing date. The entire disclosure and the contents of ('681) are hereby incorporated by reference as if fully rewritten herein.

BACKGROUND OF THE INVENTION

1. Field of the Invention

The present invention relates to an improved carbon monoxide monitoring system and, more specifically, to such a system that conditionally opens a motorized garage door at the times that carbon monoxide levels, as controlled by the presence or absence of smoke, reach unsafe thresholds.

2. Description of the Related Art

U.S. Pub. No. 2005/0,212,681, to the present inventors, discloses a garage monitoring system that includes a carbon monoxide ("CO") detector and smoke detector that generates an audible alarm when it senses CO and/or smoke at a predetermined level. There is presently no similar system that is incorporated in or works in conjunction with a standard, motorized garage door assembly.

The garage monitoring system also includes a method of determining if the garage door is opened or closed. This is necessary because the system will not issue a move door command if the garage door is already opened and it will not issue a move door command if smoke is detected first.

A carbon monoxide and smoke detector placed in a garage or a similar space has been a controversial, but a desired, feature considered to enhance a home or business' safety for many years. To enhance safety, the system will have terminals to which remote alarm can be sounded or a security system notified. To assist in determining the cause of high CO levels or smoke, the system will internal store the order of the alarm sequence (which came first, smoke or CO) and data about the concentration levels if that can be extracted from the sensor modules.

Optionally, the system may have an external carriage that accommodates garage door systems that are not activated by a wired wall switch. This is referred to as RF (Radio Frequency) only garage door opening systems. The carriage would contain the garage door opener that came with the garage door. If a garage door move command is issued, a motorized cam assembly would "press" the garage door opener's switch thus opening the door. The system could therefore be interfaced to almost any garage door opening system.

The alarm would be a sounding device that meets the loudness requirement standard and may include a light and/or voice enunciator.

The system may include a heater that helps to keep the smoke and/or CO sensors within their designated temperature range.

The system may include indirect methods of fire detection by setting a maximum temperature and/or rate of temperature change and/or infrared signature to initiate an alarm. As stated previously, in this circumstance the position of the garage door would not be changed.

The system may include indirect methods of CO detection that include the identification or periodic sounds made from running cars, lawn mowers, etc. A circuit would be included to determine if the sound origination was inside or outside of the garage.

The system will use a switch mounted on the garage door rail or some other place on the garage door assembly to determine the position of the garage door. Optionally other methods to determine the position of the garage door may be used, such as ultrasonic and/or infrared reflection techniques.

The system may contain batteries to operate during commercial power failures.

The system electronics may optionally have a timer that will indicate when the smoke or CO's sensor has reached end of life.

The present and the improved monitoring system provides the foregoing advantages by means of the emergency interface and the smoke detector. The present invention further improves home and business safety through early detection.

SUMMARY OF THE INVENTION

It is therefore an object of the present invention to provide an improved monitoring system that comprises a possible smoke detector in combination with the CO detector disclosed in the parent patent.

It is a first object of the present invention to include an improved acoustic sensor that recognizes and detects the sound that resonates from a vehicle engine that runs in a closed garage. It is an object of the improved acoustic sensor to signal the garage door to open if it detects that the sound continues for a preprogrammed time, e.g., five minutes.

It is the object of the present invention to engineer the improved monitoring system to alarm only when smoke is present, but neither open or close the garage door in those situations where smoke is detected first.

It is a further object of the present invention to program the system to reduce the risks to occupants' safety at the times when both CO and smoke are detected. This is accomplished by means of a series of programs that directs the system to leave a door closed at the times when smoke is detected first or open the door at the times CO is detected first.

It is an object of the present invention to accomplish the latter object by comprising a data recorder or a process memory in the present system. It is envisioned that the information that can be retrieved from the data recorder relates to the positions of the garage door and the levels of smoke or the levels of CO detected in the structure for the periods prior to the time when the alarm activated.

It is a further object of the present and the improved invention to comprise a manual alarm silencer on the interface of the monitoring system. It is an object of the alarm silencer to provide a means for the occupants of a structure to silence the alarm at the times that they acknowledge that there was a risk to their safety.

It is a final object of the present invention to provide all of the advantages that the foregoing objects entail.

BRIEF DESCRIPTION OF THE DRAWINGS

The advantages and the features of the present invention will become better understood with reference to the following and more detailed description and the claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the Figures.

In order to describe the complete relationship of the improved invention to its parent invention, it is essential that some description be given to the manner and to the practice of the functional utility of the garage monitoring system both disclosed in U.S. Pub. No. 2005/0212681 and incorporated herein as if fully rewritten.

Figure 1:
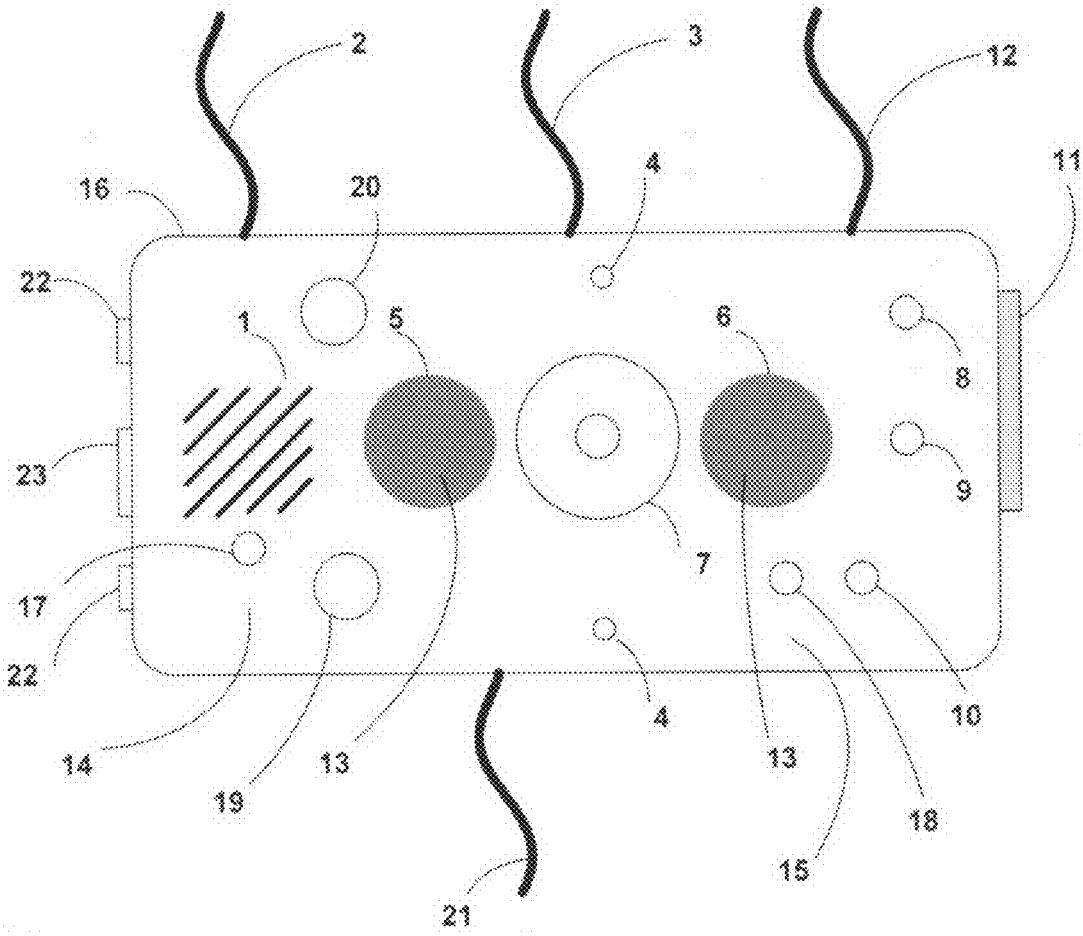
FIG. 1 is a perspective view of the garage door monitoring system disclosed in the prior art.

Referring now to FIG. 1, according to the preferred embodiment of the present invention a system is located in a plastic case 15 which is typically affixed to the ceiling or wall by screws through mounting holes 4. A power cord 12 goes to a plug-in wall transformer that powers the system. Cord 2 goes to a switch on the door rail or door assembly that tells the system whether the current position of the door is opened or closed. Alternately, the switch may be replaced by an ultrasonic, infrared ranging or other method to determine the position of the door.

Cord 3 goes to the terminals on the garage door controller. If the system issues a move door command, the connection across the wires are shorted for a period of time that signals the garage door opener to open the door. Insect and dust guards 13 protect the CO sensor detector module 5 and smoke sensor detector module 6. When CO and/or smoke is detected, an alarm is sounded 1 which may include voice annunciation and light 7 turns on. When an alarm is detected terminal strip 11 signals and remote alarm sounders or security systems.

Internal electronics 14 operate the system in accord with the operational description. An indicator 8 occasionally flashes to indicate normal smoke detector operation and comes on solid to indicate a smoke alarm. An indicator occasionally 9 occasionally flashes to indicate normal CO detector operation and comes on solid to indicate a CO alarm. Smoke alarm test switch 10 tests the operation of the smoke detector and is designed to be manually pressed. CO alarm test switch 18 tests the operation of the CO detector and is designed to be manually pressed.

Microphone 19 detects periodic sounds to indirectly identify possible sources of CO and cord 21 goes to a microphone outside of the protected area to determine if the periodic sound is coming from inside or outside of the protected area. Internal electronics 14 make a determination based upon sound intensity.

Thermal sensor in absolute temperature sensor 20 provides the internal electronics 14 the ambient temperature. The internal electronic can use this information to turn on the sensor heaters 15 located inside of the case or to sound an alarm for high temperatures or to sound an alarm if the rate of change of the ambient environment is too high.

Mounting clips 22 and electrical interface 23 serve to support the optional carriage that hold standard garage door openers for RF (radio frequency) only garage door systems.

Figure 2:
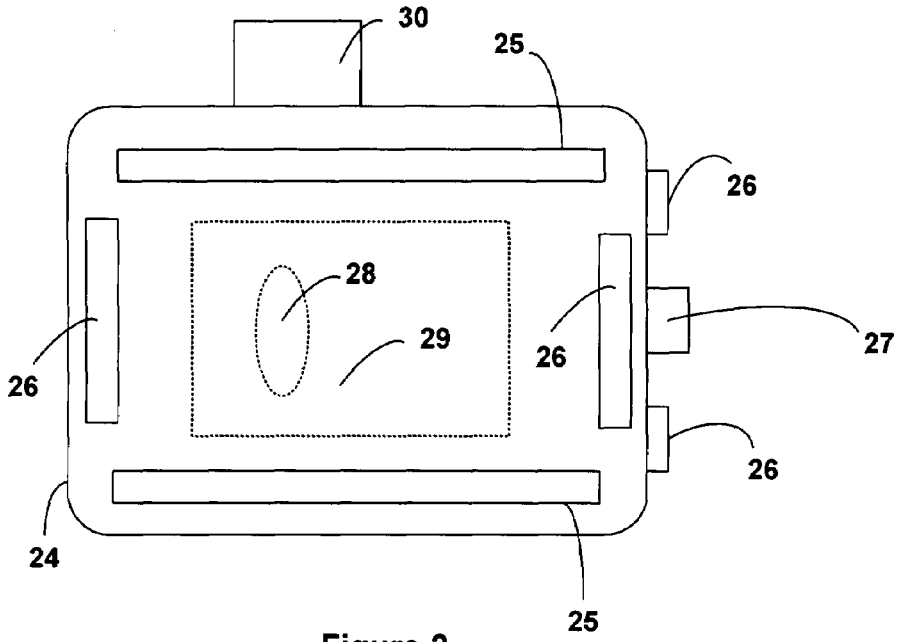
FIG. 2 is a perspective view of a garage door assembly having the improved garage monitor according to the preferred embodiment of the present invention.
Figure 3:
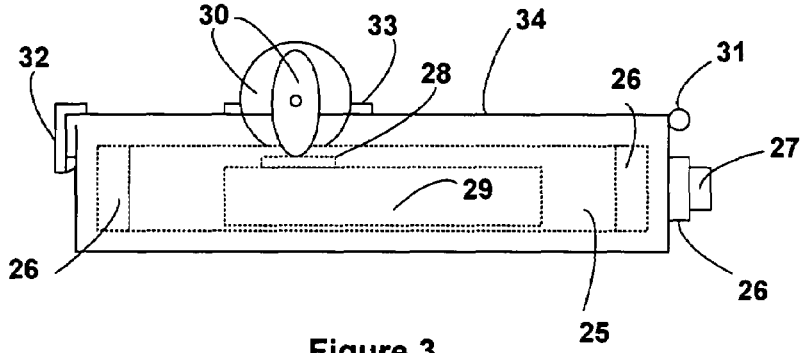
FIG. 3 is a side view of a portion of the garage door assembly and the improved garage monitor in FIG. 2.

Refer to FIGS. 2 and 3, the carriage attaches to the system mechanically 26 and electrically 27. A standard garage door opener 29 sits in the carriage assembly 24. Sliding brackets 25 and 26 move to locate and secure the garage door opener 29 so the arrange door opener's switch 28 is in the center of the carriage. The hinged 31 lid assembly 34 is then closed and latched 32. When a move door command is issued (FIG. 3 shows cam pressing switch), the motor/cam assembly 30 turns and pushes the garage door opener button 28. Spring assembly 33 adjusts tension so the garage door opener 29 is not damaged.

2. Operation of the Preferred Embodiment

The garage monitoring system also includes a method of determining if the garage door is opened or closed. This is necessary because the system will not issue a move door command if the garage door is already opened and it will not issue a move door command if smoke is detected first. The system's sequence of operation is can thus be described as follows:

a. If CO is detected first, high concentration, sound alarm and open door immediately.

b. If CO is detected first, low concentration, sound alarm and wait a time period to see if smoke alarm activates. If smoke alarm does not activate, open garage door, otherwise do not change the position of the garage door.

c. If smoke is detected first, sound alarm and do not change the position of the garage door.

The foregoing descriptions of the specific embodiments of the present invention have been presented for the purposes of illustration and description only. They are neither intended to be exhaustive nor to limit the invention to the precise forms disclosed and, obviously, many modifications and variations are possible in light of the above teaching. The embodiments were chosen and described in order to best explain the principles of the invention and its practical application, to thereby enable others skilled in the art to best utilize the invention and its various embodiments with the various modifications as are suited to the particular use contemplated. It is intended that the scope of the invention be defined by the Claims appended hereto and to their equivalents. Therefore, the scope of the invention is to be limited only by the following claims.

What is claimed is:

1. A garage monitoring and control system for use with an automatic garage door opening mechanism comprising:

a controller configured to generate a door move command for moving a garage door between an open and a closed position;

a smoke detector configured to sense the presence of smoke within the garage and generate an audible alarm when smoke reaches a predetermined level in the garage;

a carbon monoxide detector configured to sense the presence of carbon monoxide within the garage and generate an audible alarm when carbon monoxide reaches a predetermined level in the garage; and a garage door position sensor for determining whether the garage door is in an open or closed condition;

wherein said door move command of said controller is generate as follows:

a. If CO is detected first, high concentration, sound alarm and open door immediately;

b. If CO is detected first, low concentration, sound alarm and wait a time period to see if smoke alarm activates; and further if smoke alarm does not activate, open garage door, otherwise do not change the position of the garage door; and c. If smoke is detected first, sound alarm and do not change the position of the garage door.

2. The garage monitoring and control system for use with an automatic garage door opening mechanism of claim 1, further comprising:

a heater electronically controlled by a thermal sensing means for maintaining said carbon monoxide detector above a minimum operational temperature.

3. The garage monitoring and control system for use with an automatic garage door opening mechanism of claim 1, further comprising:

a monitoring mechanism interfacing with the garage door opening mechanism, the monitoring system comprising an acoustic detector for sensing audible sounds.

4. The garage monitoring and control system of claim 1, wherein said garage door position sensor is selected from the group comprising: a switch on a door rail or door assembly that tells the system whether the current position of the door is opened or closed; an ultrasonic ranging means for determining the position of the door; and an infrared ranging or other method to determine the position of the door.

5. The garage door monitoring and control system of claim 1, further comprising:

a guard capable of allowing passage of CO to the CO sensing means and smoke to the smoke detector while inhibiting the migration of insects and dust.

6. The garage door monitoring and control system of claim 1, further comprising: voice annunciation means for providing a voice generated audible alarm above a specified minimum level.

7. The garage door monitoring and control system of claim 1, further comprising:

light annunciator for providing a visual indicia of alarm.

8. The garage door monitoring and control system of claim 1, further comprising:

an audible alarm for remotely annunciating inside the user's house.

9. The garage monitoring and control system for use with an automatic garage door opening mechanism of claim 1, further comprising:

remote alarm sounder for interfacing a communication signal to a security system.

10. The garage door monitoring and control system of claim 1, further comprising an indicator that flashes intermittently to indicate normal CO detector operation and comes on steady to indicate a CO alarm.

11. The garage door monitoring and control system of claim 1, further comprising a smoke alarm test switch to test the operation of the smoke detector and is designed to be manually pressed.

12. The garage door monitoring and control system of claim 1, further comprising:

a CO alarm test switch to test the operation of the CO detector and is designed to be manually pressed.

13. The garage monitoring and control system for use with an automatic garage door opening mechanism of claim 1, wherein said smoke alarm is annunciated when the system temperature exceeds approximately 135 degrees Fahrenheit.

14. The garage monitoring and control system for use with an automatic garage door opening mechanism of claim 1, wherein said smoke alarm is annunciated when the system temperature increases at a rate exceeding approximately 10 degrees Fahrenheit per hour.

15. A garage monitoring and control system comprising:

a smoke detector configured to sense the presence of smoke within the garage and generate an audible alarm when smoke reaches a predetermined level in the garage;

a ruggedized carbon monoxide detector configured to sense the presence of carbon monoxide within the garage and generate an audible alarm when carbon monoxide reaches a predetermined level in the garage;

a heater electronically controlled by a thermal sensing means for maintaining said carbon monoxide detector above a minimum operational temperature; and a first audible alarm for remotely annunciating the operation of the smoke detector inside the user's house;

a second audible alarm for remotely annunciating the operation of the carbon monoxide detector inside the user's house;

wherein said audible alarm is generate as follows:

a. If CO is detected first, high concentration, sound the second audible alarm;

b. If CO is detected first, low concentration, sound alarm and wait a time period to see if smoke alarm activates; and d. If smoke is detected, sound the first audible alarm.

16. The garage door monitoring and control system of claim 15, further comprising:

a guard capable of allowing passage of CO to the CO sensing means and smoke to the smoke detector while inhibiting the migration of insects and dust.

17. The garage monitoring and control system for use with an automatic garage door opening mechanism of claim 15, further comprising:

Remote data communication means for interfacing with a telecommunications or internet network.

* * * * *